United States Patent [19]

Moore

[11] Patent Number: 4,459,116

[45] Date of Patent: Jul. 10, 1984

[54] SCREW PROPELLED WATER SADDLE

[76] Inventor: Georges Moore, 16,155 Hébert Blvd., St-Hyacinthe, Quebec, Canada, J2T 3W2

[21] Appl. No.: 318,624

[22] Filed: Nov. 5, 1981

[51] Int. Cl.[3] ..... B63B 35/72

[52] U.S. Cl. ..... 440/31; 440/21; 114/61; 114/283; 114/292

[58] Field of Search ..... 440/21–32; 114/61, 123, 283, 292, 270

[56] References Cited

U.S. PATENT DOCUMENTS

| | | | |
|---|---|---|---|
| 577,269 | 2/1897 | Powley . | |
| 637,547 | 11/1899 | Clark | 440/31 |
| 858,093 | 6/1907 | Mitchell | 440/31 |
| 2,484,720 | 10/1949 | Montalbano | 440/32 |
| 2,542,143 | 2/1951 | Jones | 440/31 |
| 2,684,045 | 7/1954 | Cato | 440/31 |
| 3,211,125 | 10/1965 | Yarbrough | 440/31 |
| 3,640,239 | 2/1972 | Petrovskey . | |

FOREIGN PATENT DOCUMENTS

| | | | |
|---|---|---|---|
| 630734 | 11/1961 | Canada . | |
| 802613 | 12/1968 | Canada . | |
| 195022 | 3/1906 | Fed. Rep. of Germany | 114/123 |
| 316629 | 12/1919 | Fed. Rep. of Germany . | |
| 1960373 | 7/1970 | Fed. Rep. of Germany | 440/29 |
| 473843 | 10/1914 | France . | |
| 902023 | 4/1945 | France | 440/26 |
| 1315814 | 4/1963 | France | 440/26 |
| 377214 | 6/1964 | Switzerland | 440/30 |

*Primary Examiner*—Trygve M. Blix
*Assistant Examiner*—Stephen P. Avila
*Attorney, Agent, or Firm*—Robic, Robic & Associates

[57] ABSTRACT

A screw-propelled, water saddle for ride on a water surface. This water saddle is supported by two parallel floats, properly spaced apart and joined by at least one emerging cross-member. A central bar or tubing is fixed parallel to the floats at the middle of the cross-members. The saddle is mounted on the rear part of the central bar approximately at the center of the area defined by the floats while the front end of the same receives a removable propelling and steering device comprising a screw-propeller driven by a pair of pedals and a handle-bar for steering the propeller in a given direction. The rider takes place on the saddle, puts his feet on the pedals and activates the handle-bar to place the propeller in the desired direction. This screw-propelled water saddle is particularly interesting because of its simplicity, lightness, stability, speed and manageability.

11 Claims, 10 Drawing Figures

SCREW PROPELLED WATER SADDLE

BACKGROUND OF THE INVENTION (a) Field of the invention

The present invention relates to a pedal driven, screw-propelled water saddle for ride on a smooth sea, on a lake or, more generally, on any relatively calm water surface.

This invention more especially relates to a screw-propelled water-saddle of the type comprising two parallel floats properly spaced apart and joined to each other by at least one emerging cross-member, a central supporting-bar attached between the floats, a saddle mounted onto the supporting-bar and on which may seat the rider, and a combined propelling and steering device.

(b) Description of the prior art

A few models of screw-propelled, pedal driven, water saddle have already been proposed, such as, for example, in U.S. Pat. No. 1,578,395 Mar. 30, 1926 and U.S. Pat. No. 2,663,278 Dec. 22, 1953.

These known models each comprise one or more floats onto which is installed a standard bike frame equipped with a saddle, a crank-gear and a handle-bar.

The crank-gear may be equipped with tows attached under each pedal, or may drive an immerged screw-propeller. The handle-bar serves to direct one of the floats or a vertical helm.

If, up to now, those known models to a certain extent have proved to be rather satisfying, they nevertheless remain heavy, slow, hard to drive and steer and hardly movable from one place to another. Moreover, most of these known models have the major drawback of being unstable; the saddle being too high with regard to the floats.

SUMMARY OF THE INVENTION

An object of the present invention is to provide a screw-propelled, water saddle which, advantageously, does not present any of the above mentioned drawbacks.

Another object of the invention is to provide a screw-propelled, water saddle which has a simple and light structure and therefore is speedy, manageable, easy to transport and put away, and especially very safe owing to its stability and floatability.

In accordance with the present invention, these objects are achieved with a screw-propelled, water saddle comprising:

two parallel floats connected to each other by at least one emerging cross-member;

a central support bar fixed to the middle of the cross-member between the floats;

a saddle mounted onto the central support bar so as to be located substantially in the middle of the surface defined by the parallel floats; and a propelling and steering device mounted onto the central support bar in front of the saddle, which device comprises a screw-propeller driven by a pair of pedals and means for orientating the propeller so as to steer the water saddle in a given direction.

This structure is particularly simple and light. This structure is also very easy to steer as steering is done by mere orientation of the screw-propeller operated by the pedals which thus serves not only as propelling means but also as steering means.

More especially, this structure has a particularly high stability owing to the position of the saddle which is mounted onto the central support bar so as to be substantially in the middle of the surface defined by the floats. This original disposition substantially lowers the center of gravity of the whole device and thus allows for a better distribution of the rider's weight on both floats.

In accordance with a preferred embodiment of the invention, the screw-propelled, water saddle comprise two cross-members respectively located in the middle and front of the floats. These two members are preferably M-shaped so as to allow free motion of the rider's legs.

These cross-members may be made of light metal casting or bent tubing. They may also be replaced by a reinforced cupola to protect the rider's legs from the sun and to add to the aesthetic aspect of the whole.

In accordance with another preferred embodiment of the invention, each pedal is provided with a vertical blade which acts as a pendulum and thus ensures a perfect positioning of the pedal for receiving the rider's foot.

In accordance with a further preferred embodiment of the invention, the screw-propeller is mounted on a propeller shaft which is mechanically connected to a counter-shaft by means of a pair of spiral bevel gears. The counter-shaft is mechanically connected to the pedals bymeans of a pair of hypoid bevel gears. The propelling and steering device preferably comprises a sleeve on which is mounted the propeller shaft and through which can freely rotate the counter-shaft, together with a steering handle-bar connected directly to the sleeve to rotate the same about the counter-shaft and thus to steer the propeller and its shaft in the given direction while keeping in an operative, engaged position the pinions of the gears.

The latter arrangement is particularly advantageous since it gives to the propelling and steering device a simple and light structure.

DRAWINGS

The present invention will be better understood with reference to the following description of a preferred embodiment thereof, taken in connection with the accompanying drawings, in which.

Figure 6:
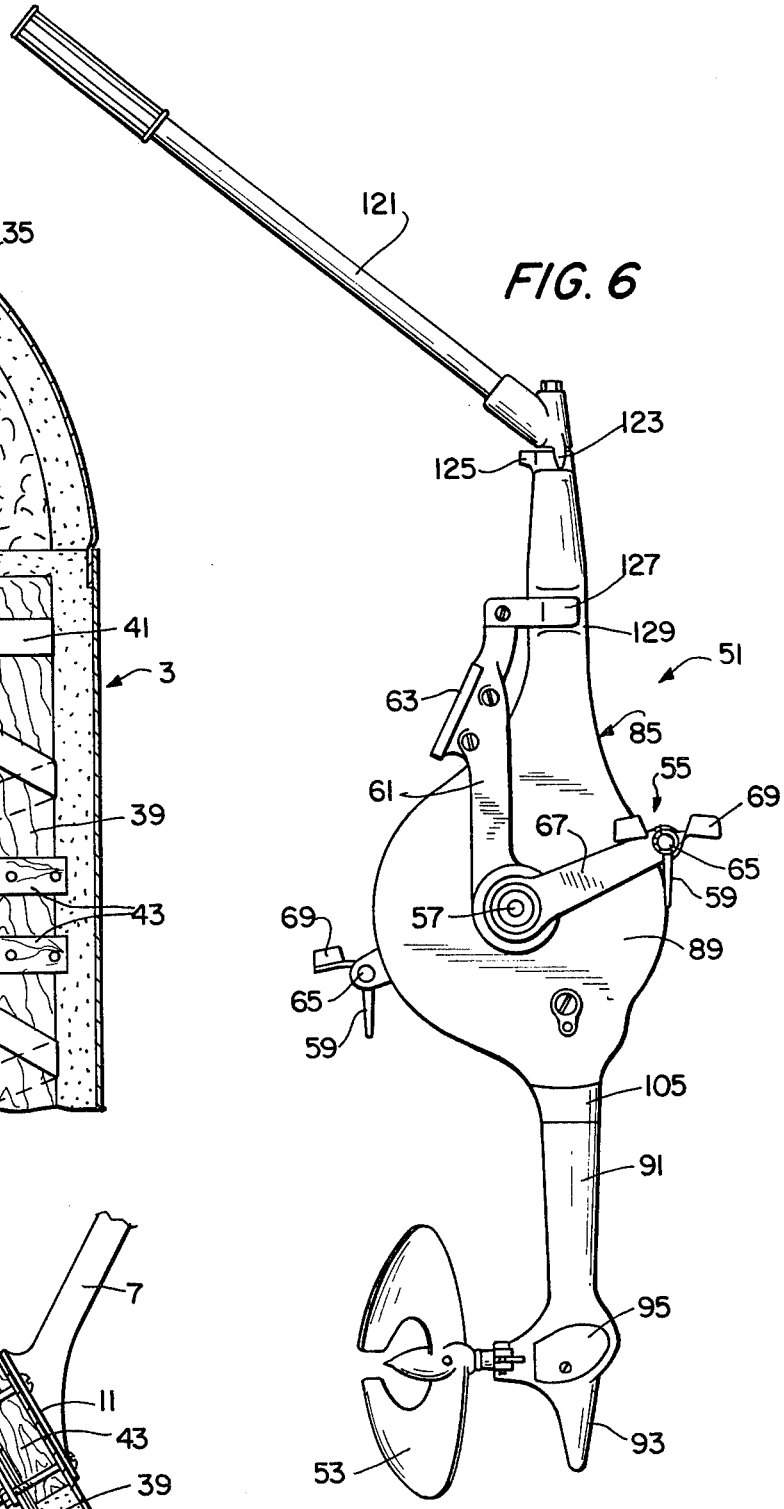
FIG. 6 shows an elevational view of the propelling and steering device of the water saddle shown in FIG. 1.
Figure 7:
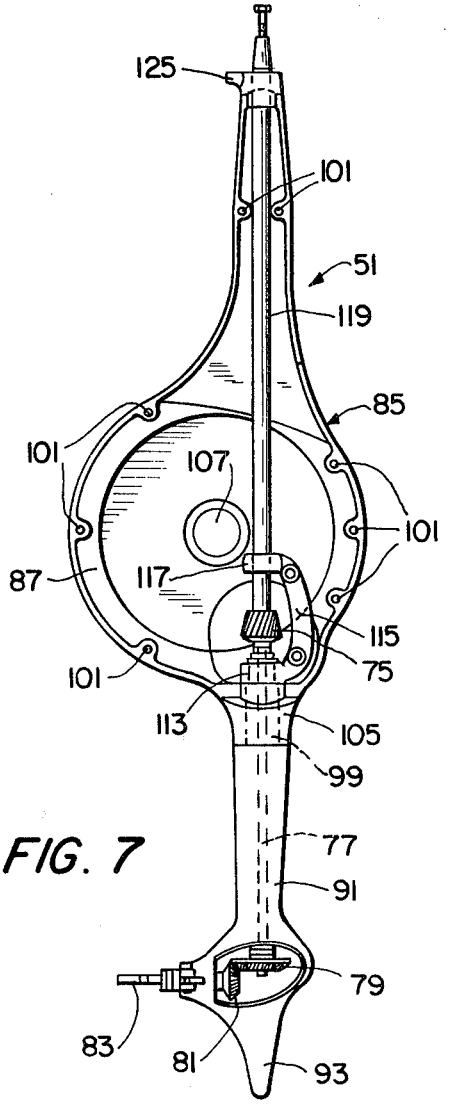
Figure 8:
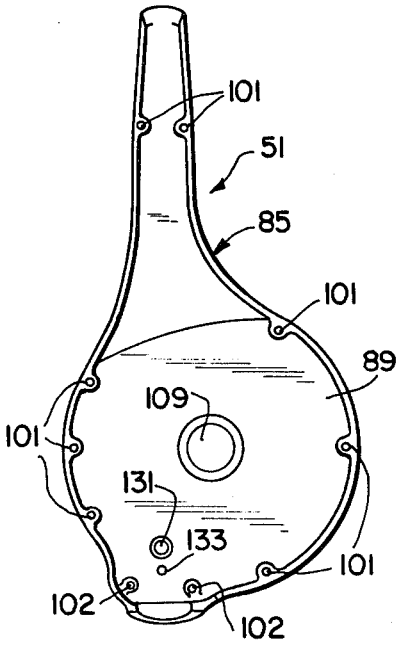
Figure 10:
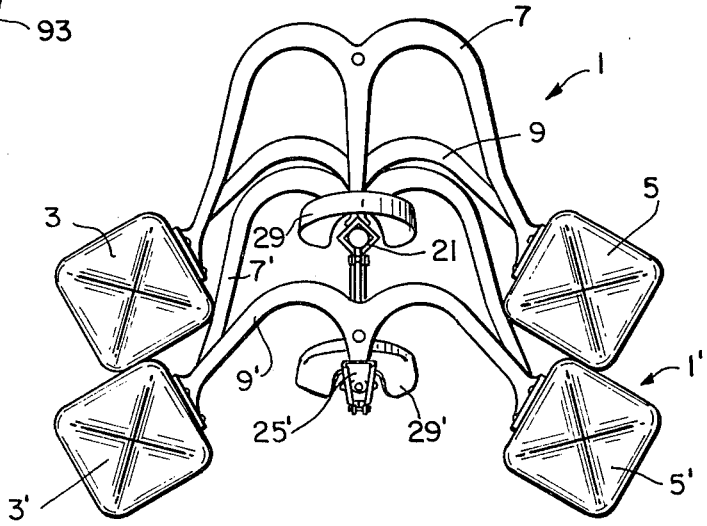
Figure 9:
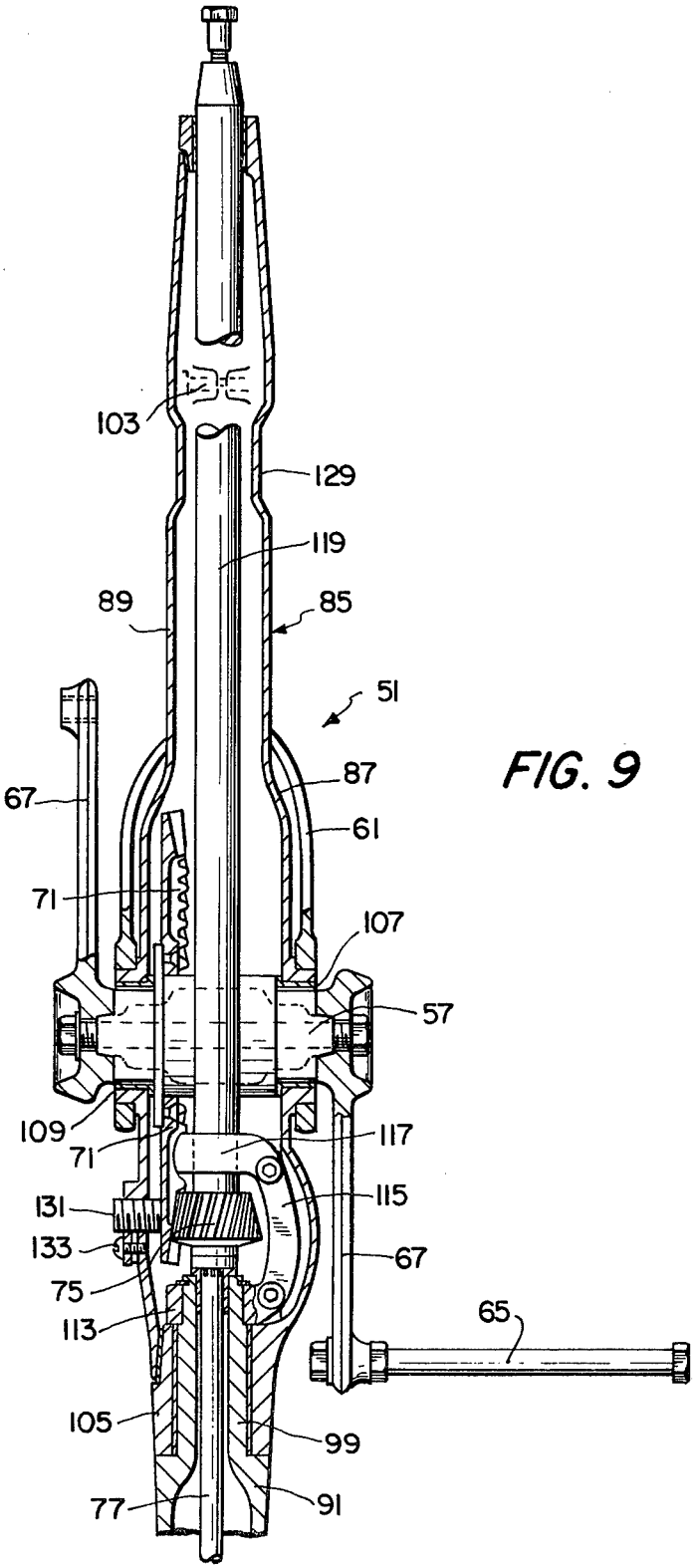

FIGS. 7 and 8 respectively show both parts of the casing containing the propelling and steering device shown in FIG. 6;

FIG. 9 shows a transversal, cross-sectional view of the propelling and steering device shown in FIG. 6; and FIG. 10 shows a front view of two water saddles stacked one upon the other.

DESCRIPTION OF A PREFERRED EMBODIMENT

Figure 1:
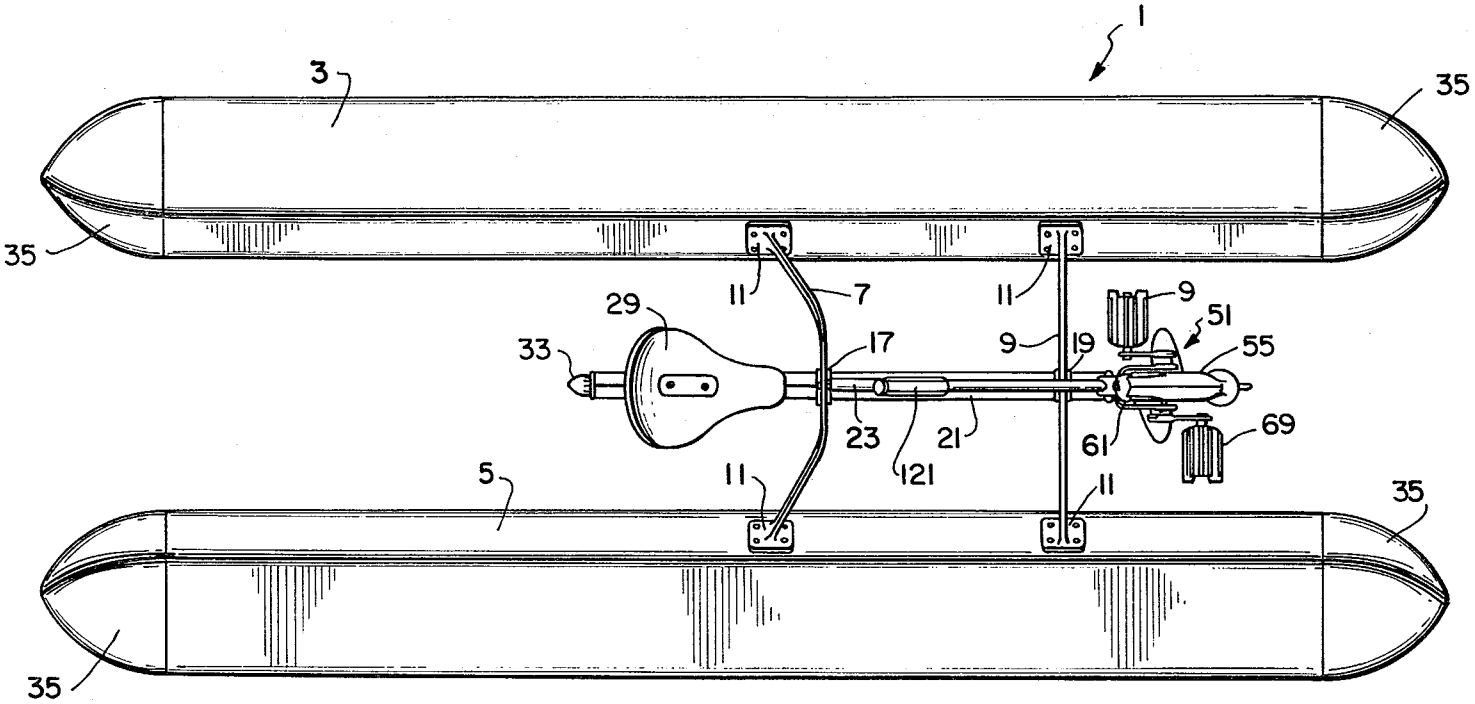
FIG. 1 shows a top plan view of an of a screw-propelled, water saddle according to the invention.
Figure 2:
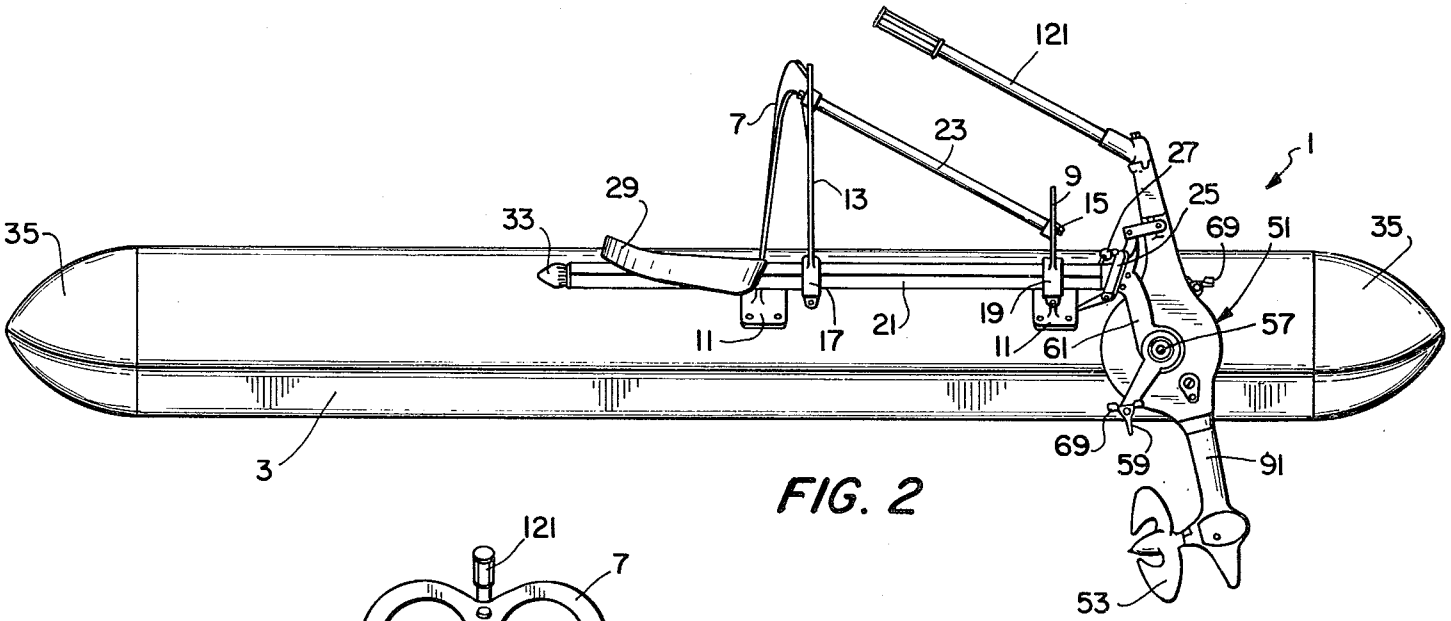
FIG. 2 shows a side elevational view of the water saddle shown in FIG. 1, seen in cross-section.
Figure 3:
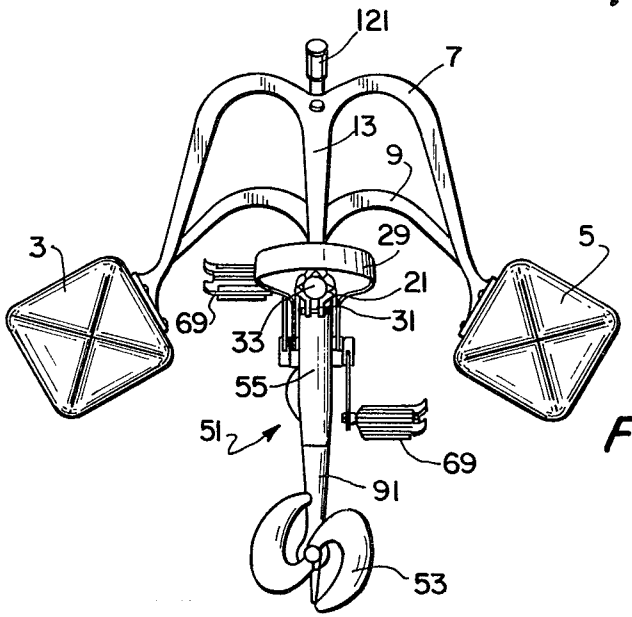
FIG. 3 shows a rear elevational view of the water saddle shown in FIGS. 1 and 2.

The screw-propelled water-saddle illustrated in FIGS. 1, 2 and 3, comprises two elongated floats 3 and 5 of identical shape and structure, that extend parallel to each other and are joined by a pair of cross-members 7 and 9. Each of these cross-members has substantially the shape of large M with rounded angles as clearly shown on FIG. 3, and bears at its ends a fixing plate 11 for bolting to the floats 3 and 5.

The cross-member 7 is titled towards the front and rises higher than the member 9 to allow free motion of the rider's thighs. This cross-member 7 is bolted to the floats at approximately the middle of their lengths.

The cross-member 9 is not as high as the cross-member 7 and it extends perpendicularly to the floats to which it is bolted in front of the cross-member 7.

Both cross-members 7 and 9 are downwardly extended by short members 13 and 15 that are terminated by collars 17 and 19 shaped to receive a central supporting-bar 21.

The lengths of the short members 13 and 15 are determined so as to keep the central supporting-bar horizontal at a proper height over the surface of the water. The cross-members 7 and 9 are joined by a diagonal brace 23 extending above the central supporting-bar 21.

The central-bar 21 extends slightly in front of the cross-member 9 and is equipped with a special bracket having a trapezoidal notch 25 allowing quick setting of a propelling and steering device 51 that will be described hereinafter.

The central supporting bar 21 extends long enough behind the cross-member 7 to give room to the saddle 29 and to allow it to be slided and fixed according to the length of the rider's legs.

A removable screw driver 33 may be integrated at the rear end of central-bar 21 to supply the needed tool to tighten and untighten the saddle on its supporting-bar and to adjust the bar itself in the collars 17 and 19.

The cross-members 7 and 9 can be made of light metal i.e. aluminum casting or bent aluminium round tubing, as well as the diagonal brace 23. The central supporting-bar 21 can be made of a square, round-cornered aluminium tubing, to prevent the saddle and the propelling device to rotate over the bar.

The length of the floats 3 and 5 may vary according to the safe sustentation needed; for example, for a load of 200 pounds, use should be made of 8×8 inches square 90 inches long floats.

Figure 4:
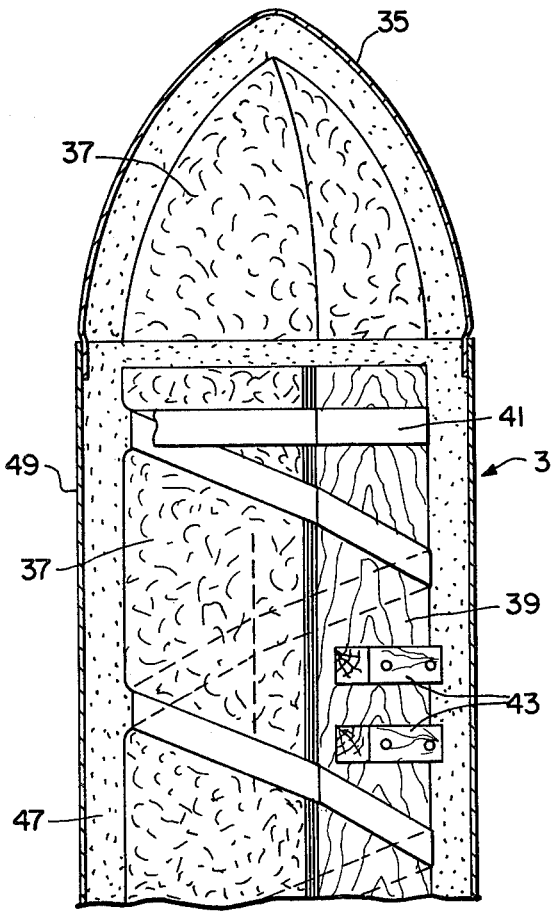
FIG. 4 shows a partial, cross-sectional and longitudinal view of one of the floats.
Figure 5:
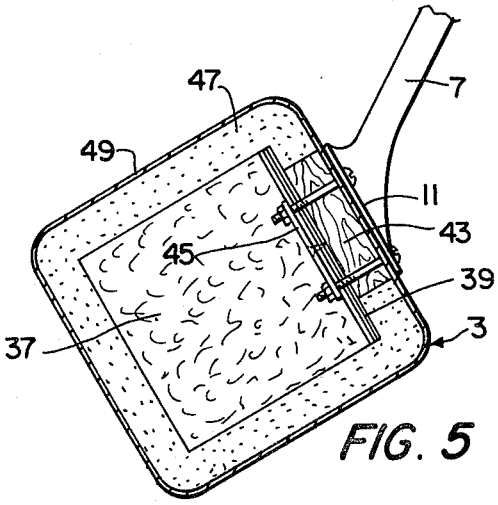
FIG. 5 shows a transversal, cross-sectional view of the floats shown in FIG. 4.

Each float is straight and has a constant square, round-corner cross-section. To minimize the resistance opposed by the water, both ends of these floats have an ogival shape. Referring to FIGS. 4 and 5, each float includes a rigid plastic foam core 37 extending through the whole length of the float. This plastic foam core has a square cross-section and is reinforced on one side by a veneer board 39 attached with a fiber-glass reinforced adhesive tape 41 wrapped around the plastic foam core. A set of hardwood shims 43 is fixed to the veneer board where the fixing plates 11 of the cross-members 7 and 9 are to be bolted to the floats through the threaded plates 45. The hardwood shims also supply a space between the core and the fiber-glass shell 49, this space being filled with foam plastic 47 self generated in place. The fixing plates 11 at the ends of the cross-members 7 and 9 are inclined so that the floats be symmetrical and their lateral surfaces make with a horizontal plane, non equal, complementary angles to realize stable equilibrium, when two or more entire units, with their propelling devices removed, are stacked (see FIG. 10).

Referring to FIGS. 6 to 9, the combined propelling and steering device 51 to be mounted at the front end of the central supporting-bar 21 includes a screw-propeller 53 driven from a crank-gear axle 57 bearing a pair of levers 67 each provided with a pedal axle 65 and foot support 69. The axle 57 rotates a bevel gear 71 which drives a pinion 75 and a countershaft 77 which in turn rotates a spiral bevel gear 79 and a spiral bevel pinion 81 keyed to a screw-propeller shaft 83.

Advantageously, the bevel gear 71 and pinion 75 have a high speed-up ratio while the spiral bevel gear 79 and pinion 81 have a speed-up ratio of two-to-one to make it as small as possible.

To avoid corrosion, all gears and pinions are made of strong plastic material such as Nylon (trademark). The gearing is contained in a two-part casing 85 and 89 which is itself mounted on a fork 61 where it is free to tilt in the event that a spur 93 forming part of the casing meets shocks or other obstacles. The device 51 is returned to normal position under the action of the screw-propeller and is held in place by the pair of spring blades 127 or by a permanent magnet. The fork 61 is provided with a trapezoidal tenon 63 to be engaged in the mortise of the bracket 25 and is held in place by the hand screw 27.

The casing 85 bears on its down end a socket or sleeve 91 containing the countershaft 77, the gear and pinion 79 and 81 and the propeller shaft 83. The upper-end of the sleeve 91 forms a pivot fitting a bushing 105 which is part of the casing 85.

Preferably, the casing 89 and the sleeve 91 are hydrodynamically shaped so as to offer minimal resistance in water.

The lower part of the sleeve 91 is provided with openings giving access to the gear and pinion 79 and 81. Those openings are closed by a pair of caps 95 retained by a screw as shown in FIG. 6. The sleeve 91 is also equipped at its down-end with the above mentioned spur 93 to protect the propeller.

As described hereinabove, the propelling device serves also as steering means by mere orientation of the screw-propeller towards the right or the left. This orientation is carried out by rotation of the sleeve 91. For this purpose, the pivot 99 is connected to a steering column 119 through a connector 115 straddling the pinion 75. The column 119 extends upwards inside the casing and reaches a handle-bar 121 through an elbow 123. The column 119 must be in perfect alignment with the countershaft 77 and pass besides the crank-gear axle 57. As a result, the pinion 75 must be out of the axis line of the gear 71, such being realized by the use of a hypoid type of bevel gears.

The elbow 123 is equipped with stop ears meeting stop blocks 125 to prevent the connector 115 to damage the gear 71. Other stop blocks 133 shown on FIG. 8 are integrated inside the casing and add to the dependability of the mechanism.

The gear 71 made of plastic has a flexible blank; its teeth are maintained engaged in the pinion 75 by a threaded button 131 that can be locked after setting by a screw 133.

As aforesaid, the various mechanical elements previously described are assembled through conventional bushing inside a casing composed of a main part 85 and a cover 89 both made of light metal or other strong material held together by guide pins and screws 101 as shown on FIG. 8. However it should be noted that other fastening means may also be used.

The parts of the casing each comprise a cylindrical ring concentric to the crank-gear axle. This ring fits in the round hole at the lower part of the fork 61; this arrangement allows the whole propelling and steering device to tilt freely in the fork.

The ring is internally provided with plastic bushings 107 and 109 in which turns the crank-gear axle 57.

The casing receives and protects the bevel gear 71 and the pinion 75 keyed to the upper part of the countershaft 77. The casing receives alike at its down part 105 the pivot 99 of the swivelling sleeve 91.

The lower part of the connector 115 forms a collar 113 which after tightening, holds in place the sleeve 91 and governs the orientation of the screw propeller through the column 119. The casing 85-89 extends upwardly and is provided with proper guiding bushings.

To prevent any interference of the connector 115 with the teeth of the bevel gear 71 when turning the handle bar 121, the elbow 123 is provided with two lateral ears which limit the rotation by contact with the stop block 125 integrated to the upper part of the casing.

The casing containing the whole mechanism of the propelling and steering device is freely mounted on the fork 63 which is provided with spring blades 127 or a permanent magnet placed at a proper distance from the tilting axle.

This arrangement is particularly advantageous as it maintains vertical the whole propelling and steering device while permitting its tilting under a little shock or resistance at the spur 93 for the protection of the propeller 53.

The screw propelled and steered, pedal driven water-saddle described hereinabove offers numerous advantages: its structure and mechanism are simple, easy to operate. Moreover, it is very light. Thus, for example, the weight of the whole unit described hereinabove may not exceed 30 pounds with the propelling device included. Thus, it can easily support in a safe manner a load of 200 pounds. Its lightness makes its handling easy.

To enter the water, the rider stands between the floats. Using the central cross-member, he raises the whole unit and where a proper deepth is reached, he lays it down on the water. Then seated on the saddle, he places his feet on the pedals and steers with the handlebar. The saddle being substantially at the same height than the top of the floats, the gravity center of the whole assembly is very low and then the possibility of overturning are almost nil. As it can be clearly seen in FIG. 2, this lowering of the gravity center is favoured by the fact that the pedals are operated under water.

To facilitate the use of the water-saddle, the pedals are equipped with vertical blades 59 producing a pendulum effect that place them in favorable position to receive the feet. This feature is particularly interesting as the pedals are only visible in very clear water. Furthermore, those blades have a propelling effect that can be an advantage in the event of trouble with the screw-propeller.

What is claimed is:

1. A screw-propelled, water saddle comprising:

two parallel floats connected to each other by two emerging cross-members, one of said cross-members being placed at the front end of the floats while the other is placed substantially at the middle thereof, said cross-member located at the middle of the floats being higher than the one placed at the front, both of said cross-members having the shape of a M with rounded angles, a central support bar fixed to the middle of the cross-members between the floats;

a saddle mounted onto the central support bar so as to be located substantially in the middle of a surface defined by a plane passing through the parallel floats; and a propelling and steering device mounted onto the central support bar in front of the saddle, said device comprising a screw-propeller driven by a pair of pedals and means for orientating the propeller so as to steer the water saddle in a given direction, wherein said screw-propeller comprises a propeller shaft mechanically connected to a countershaft by means of bevel gears, said countershaft being itself mechanically connected to the axle of the pedals by means of hypoid bevel gears, and wherein said means for orientating the screw-propeller comprises a sleeve in which is mounted the propeller shaft and through which may freely turn the countershaft, a steering column aligned with the countershaft, said column being solid with the sleeve, and a handle bar fixed to the column to turn the sleeve in the desired direction while the bevel gears remain engaged.

2. A screw-propelled water saddle as claimed in claim 1, wherein the hypoid bevel gears driven by the pedals are enclosed with a casing mounted at the front end of the central bar through a fork so that it may rotate around the pedal axle in a vertical plane passing between the floats.

3. A screw-propelled water saddle as claimed in claim 2, wherein the sleeve is rotatably mounted under the casing and the steering column extends in the casing.

4. A screw-propelled water saddle as claimed in claim 3, wherein the steering column is connected to the sleeve through a connector located inside the casing and straddling over the hypoid bevel gears.

5. A screw-propelled water saddle as claimed in claim 4, wherein the hypoid bevel gears have a high speed up ratio.

6. A screw-propelled water saddle as claimed in claim 4, wherein the bevel gears connecting the propeller shaft to the countershaft have a speed up ratio of two to one so that their size be as small as possible.

7. A screw-propelled water saddle as claimed in claim 1, wherein the pedals are each provided with a vertical blade producing a pendulum effect that keeps them in favorable position to receive the feet.

8. A screw-propelled water saddle as claimed in claim 1, wherein the cross-members are joined by a diagonal brace extending above the central bar.

9. A screw-propelled water saddle as claimed in claim 1, wherein the saddle is adjustable along the central bar.

10. A screw-propelled water saddle as claimed in claim 1 or 9, wherein the central bar is slidable with respect to the cross-members and then to the floats.

11. A screw-propelled water saddle as claimed in claim 1, wherein the propelling and steering device is mounted on the central bar through a fork allowing the device to tilt around the pedal axle.

* * * * *